US006925724B2

(12) United States Patent
Tandy

(10) Patent No.: US 6,925,724 B2
(45) Date of Patent: Aug. 9, 2005

(54) QUILTING RULER

(75) Inventor: Rachel Claire Tandy, Leicester (GB)

(73) Assignee: Creative Grids (UK) Limited (GB)

( * ) Notice: Subject to any disclaimer, the term of this patent is extended or adjusted under 35 U.S.C. 154(b) by 0 days.

(21) Appl. No.: 10/381,973

(22) PCT Filed: Sep. 25, 2001

(86) PCT No.: PCT/GB01/04259

§ 371 (c)(1),
(2), (4) Date: Jul. 15, 2003

(87) PCT Pub. No.: WO02/29147

PCT Pub. Date: Apr. 11, 2002

(65) Prior Publication Data

US 2004/0049935 A1 Mar. 18, 2004

(30) Foreign Application Priority Data

Oct. 5, 2000 (GB) ..... 0024349

(51) Int. Cl.[7] ..... G01B 3/14

(52) U.S. Cl. ..... 33/563; 33/1 B; 33/566; 33/483; 33/489; 33/494

(58) Field of Search ..... 33/1 B, 562, 563, 33/564, 566, 483, 484, 489, 493, 494, 476

(56) References Cited

U.S. PATENT DOCUMENTS

| | | | | | |
|---|---|---|---|---|---|
| 1,497,492 | A | * | 6/1924 | Engel | 33/494 |
| 1,708,551 | A | * | 4/1929 | Nell | 33/476 |
| 1,742,684 | A | * | 1/1930 | Levi Bowman | 33/563 |
| 2,522,908 | A | * | 9/1950 | Szabo | 33/489 |
| 3,738,010 | A | * | 6/1973 | Carder | 33/489 |
| 4,584,780 | A | * | 4/1986 | Pressey | 33/563 |
| 4,734,993 | A | | 4/1988 | Pan | |
| 4,779,346 | A | | 10/1988 | Schafer | |
| 5,557,996 | A | * | 9/1996 | Reber et al. | 33/562 |
| 5,791,062 | A | | 8/1998 | Walker | |
| 5,819,422 | A | * | 10/1998 | Schafer | 33/1 B |
| 5,829,150 | A | | 11/1998 | McEligot | |
| 6,158,135 | A | * | 12/2000 | Rank | 33/494 |
| 6,276,070 | B1 | | 8/2001 | Hawley | |
| 2003/0110653 | A1 | * | 6/2003 | Schafer | 33/562 |

FOREIGN PATENT DOCUMENTS

| | | |
|---|---|---|
| GB | 754282 | 8/1956 |
| JP | 55-152401 | 11/1980 |
| WO | WO 96/13393 | 5/1996 |

* cited by examiner

*Primary Examiner*—Christopher W. Fulton
*Assistant Examiner*—Madeline Gonzalez
(74) *Attorney, Agent, or Firm*—Young & Basile, P.C.

(57) ABSTRACT

A quilting ruler is square or rectangular in shape and has first, second, third and fourth edges with a first set of equally spaced rulings running parallel to the first and third edges of the ruler and at right angles to a second set of equally spaced rulings running parallel to the second and fourth edges of the ruler. The first line of the first set of rulings is spaced from the first edge of the ruler by a different interval from the interval by which the last line of that set of rulings is spaced from the third edge of the ruler, and the distance of each line of the first set of rulings from the first edge and of each line of the second set of rulings from the second edge is marked so as to be visible when the first and second edges of the ruler are in use and the distance of each line of the first set of rulings from the third edge and of each line of the second set of rulings from the fourth edge is marked so as to be visible when the third and fourth edges of the ruler are in use.

19 Claims, 4 Drawing Sheets

QUILTING RULER

Figure 1:
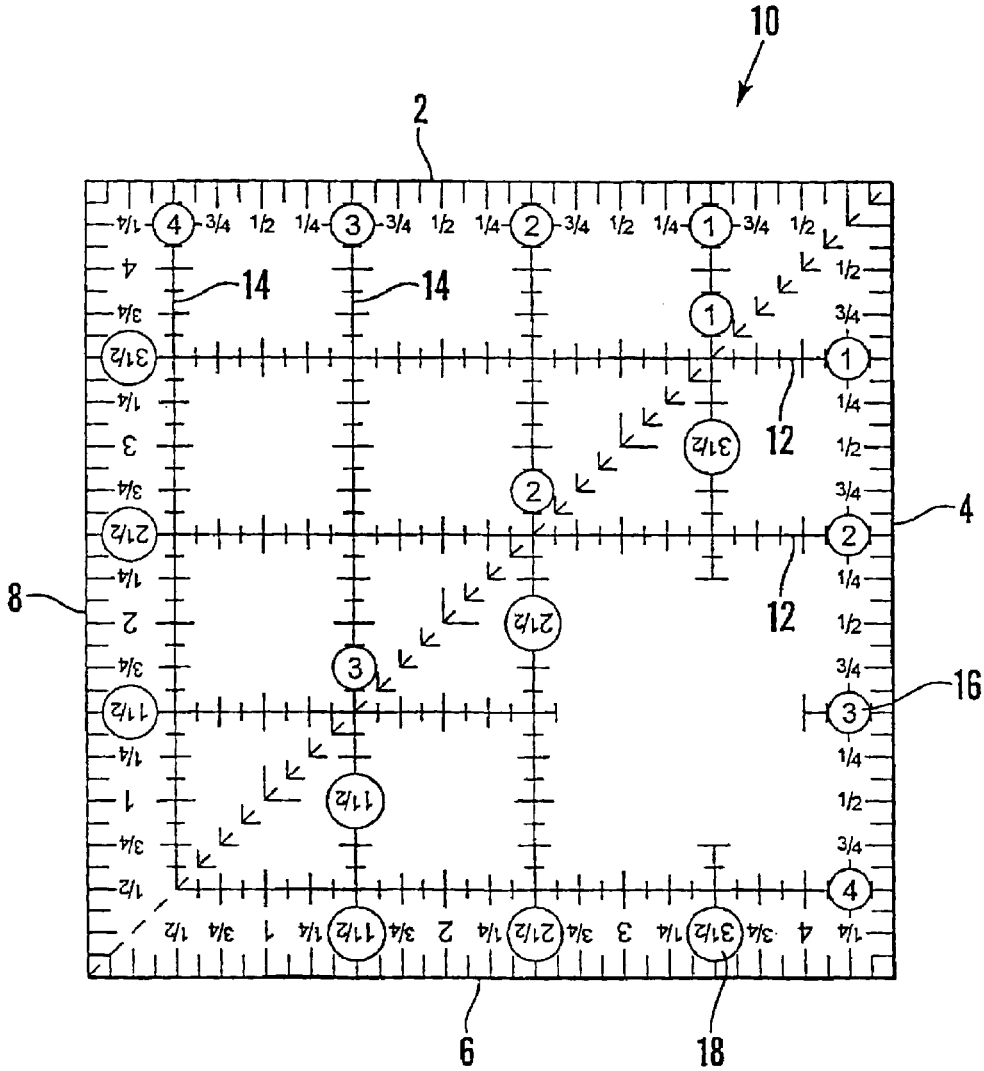

This application is a continuation of International Application No. PCT/GB01/04259 filed on Sep. 25, 2001.

The present invention relates to an improved ruler, in particular to an improved quilting ruler.

It is known to provide rulers for use in quilting, which rulers are provided with a series of markings to enable the quilter to measure and cut the fabric to be used in the production of the quilt according to specific predetermined measurements in order to follow a pattern. Because of the fact that a large number of pieces of fabric are required for each article, it is necessary for the ruler to be clear and easy to use.

The patterns used for the production of quilts are produced almost exclusively in the United States and are therefore described in Imperial units and, although the improved rulers of the present invention are not limited to Imperial units, the improved rulers of the present invention are particularly suitable for use with such units.

Known quilting rulers for use with Imperial units are generally square or rectangular in form and are generally delimited in intervals of 1" (2.54 cm) since this is the closest spacing of rulings which can be clearly and conveniently used by a quilter. Additional supplementary markings are provided at, generally quarter-inch intervals. In order for the quilter to obtain patterns of sufficient complexity, it is necessary for the quilter to be able to cut pieces of fabric at half-inch measurements, so that it is necessary for the quilter to use these additional supplementary markings when measuring and cutting fabric. This increases the time taken to cut the fabric and increases the chances of error, since the additional supplementary markings are not so clear as the main markings.

Quilting rulers are known which are square or rectangular in shape. In use, the quilter arranges the ruler on the fabric to be measured and cut so that the desired design or piece of fabric is correctly positioned, and then measures to the desired size and cuts along the edge of the ruler. If it is desired to cut a piece of fabric measuring, for example 2 inches by 2½ inches, then the quilter will need to use the additional supplementary markings in order to make the second measurement.

It is an object of the present invention to provide an improved quilting ruler in which the above disadvantages are reduced or substantially obviated.

The present invention provides a quilting ruler which is square or rectangular in shape and has first, second, third and fourth edges, with a first set of equally spaced rulings running parallel to the first and third edges of the ruler and at right angles to a second set of equally spaced rulings running parallel to the second and fourth edges of the ruler, characterised in that the first line of the first set of rulings is spaced from the first edge of the ruler by a different interval from the interval by which the last line of that set of rulings is spaced from the third edge of the ruler, and the distance of each line of the first set of rulings from the first edge and of each line of the second set of rulings from the second edge is marked so as to be visible when the first and second edges of the ruler are in use and the distance of each line of the first set of rulings from the third edge and of each line of the second set of rulings from the fourth edge is marked so as to be visible when the third and fourth edges of the ruler are in use.

In a preferred embodiment of the ruler according to the invention, the first line of the first set of rulings is spaced at an interval of one inch from the first edge of the ruler and successive lines in the first set of rulings are spaced each at one inch from the previous line and the last line in the first set of rulings is spaced at an interval of one half inch from the third edge of the ruler.

In a further preferred embodiment of a quilting ruler according to the invention, the first line of the second set of rulings is spaced from the second edge of the ruler by a different interval from the interval by which the last line of that set of rulings is spaced from the fourth edge of the ruler.

In a particularly preferred embodiment of the ruler according to the invention, the first line of the second set of rulings is spaced at an interval of one inch from the second edge of the ruler and successive lines in the second set of rulings are spaced each at one inch from the previous line and the last ruling in the second set of rulings is spaced at an interval of one half inch from the fourth edge of the ruler.

The distance of each line of the first set of rulings from the first edge and of each line of the second set of rulings from the second edge is preferably marked by printing a reference numeral on the surface of the ruler, specifying the distance of that line from the edge of the ruler so as to be visible when the first and second edges of the ruler are in use, generally when the first and second edges of the ruler are located as the right hand and the upper edges of the ruler and the distance of each ruling of the first set of rulings from the third edge and of each ruling of the second set of rulings from the fourth edge is marked so as to be visible when the third and fourth edges of the ruler are in use, generally when the third and fourth edges of the ruler are located as the right hand and the upper edges of the ruler.

The set of reference numbers specifying the distances from the first and second edges are preferably printed inverted by 180 degrees relative to the reference numbers specifying the distances from the third and fourth edges. The reference numbers may be printed in known manner in a combination of colours in order to enhance visibility on differently coloured fabrics.

The rulers according to the present invention may be made from any suitable material, in particular a suitable transparent material. It is particularly preferred that the rulers according to the invention are manufactured from acrylic, which may be extruded or, more preferably, cast. The rulers may be provided in known manner with a non-slip surface on their reverse or fabric contacting face.

Figure 2:
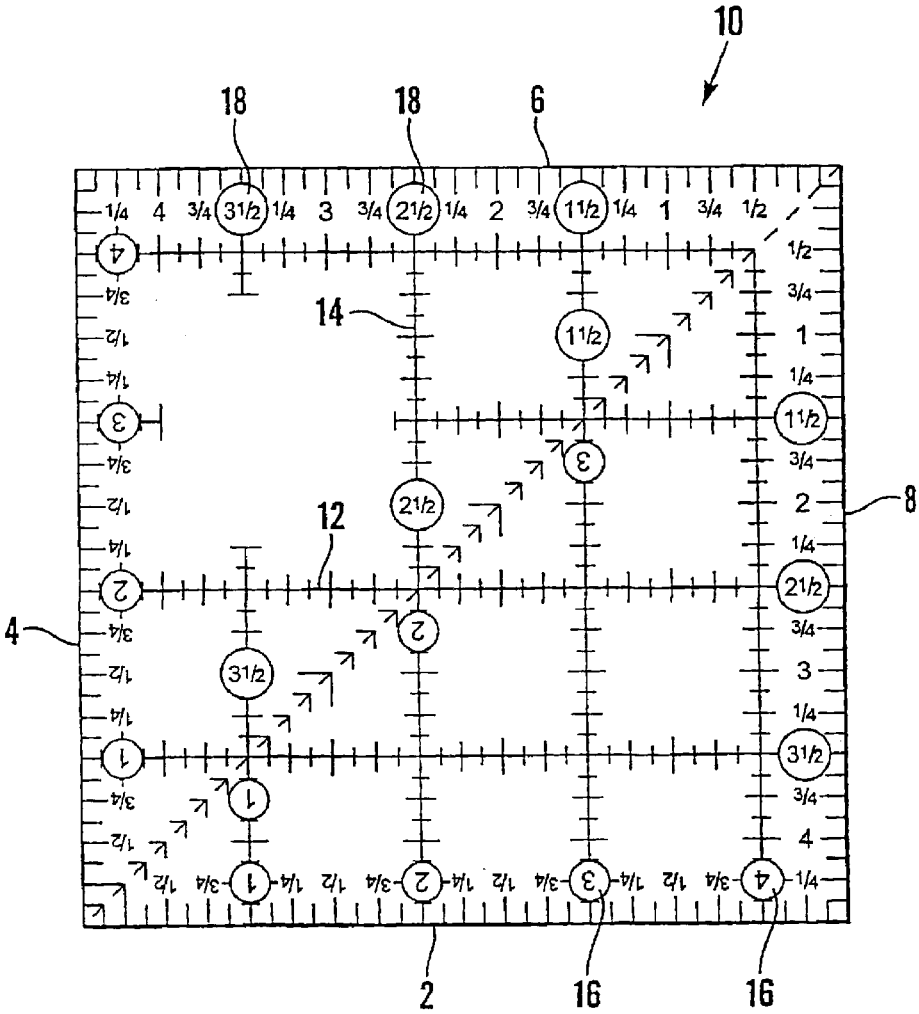
Figure 3:
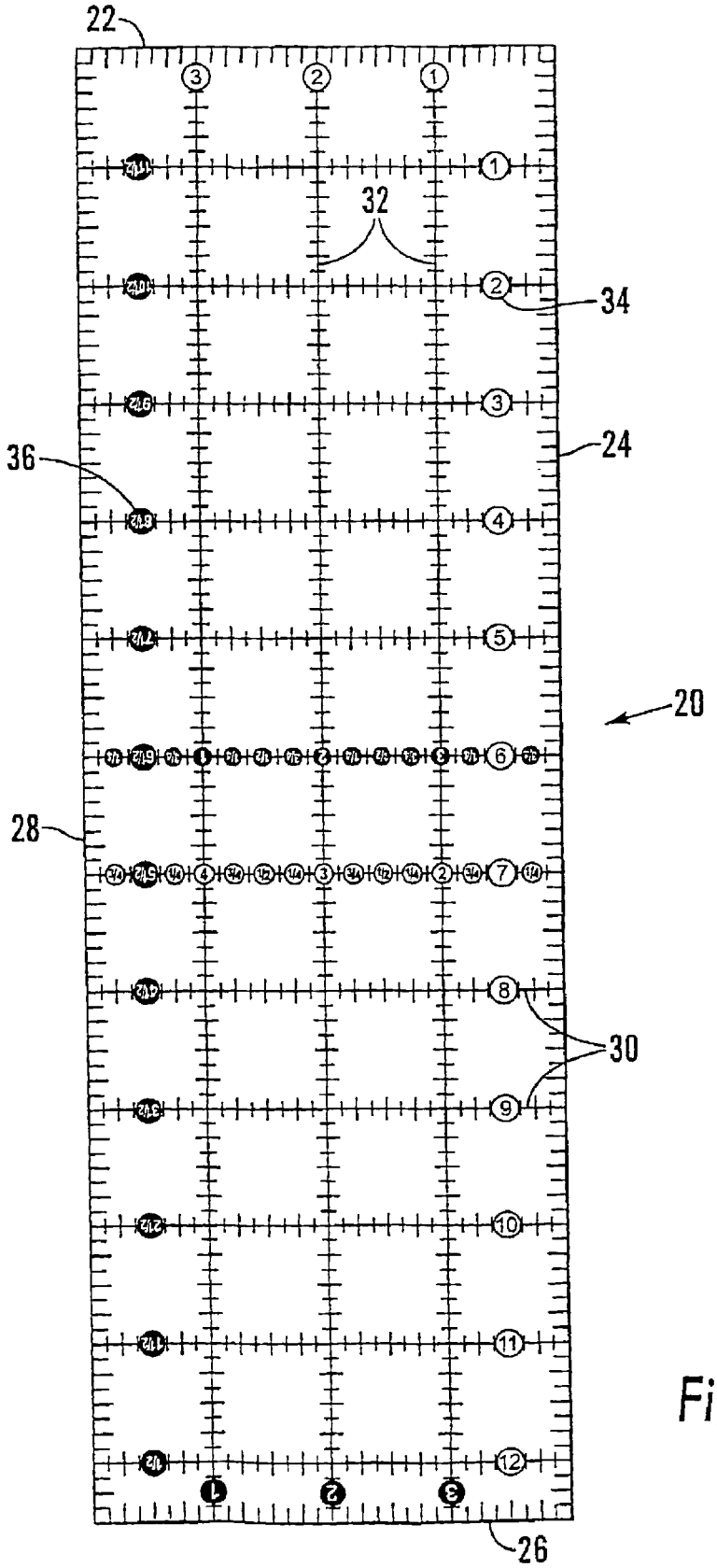
Figure 4:
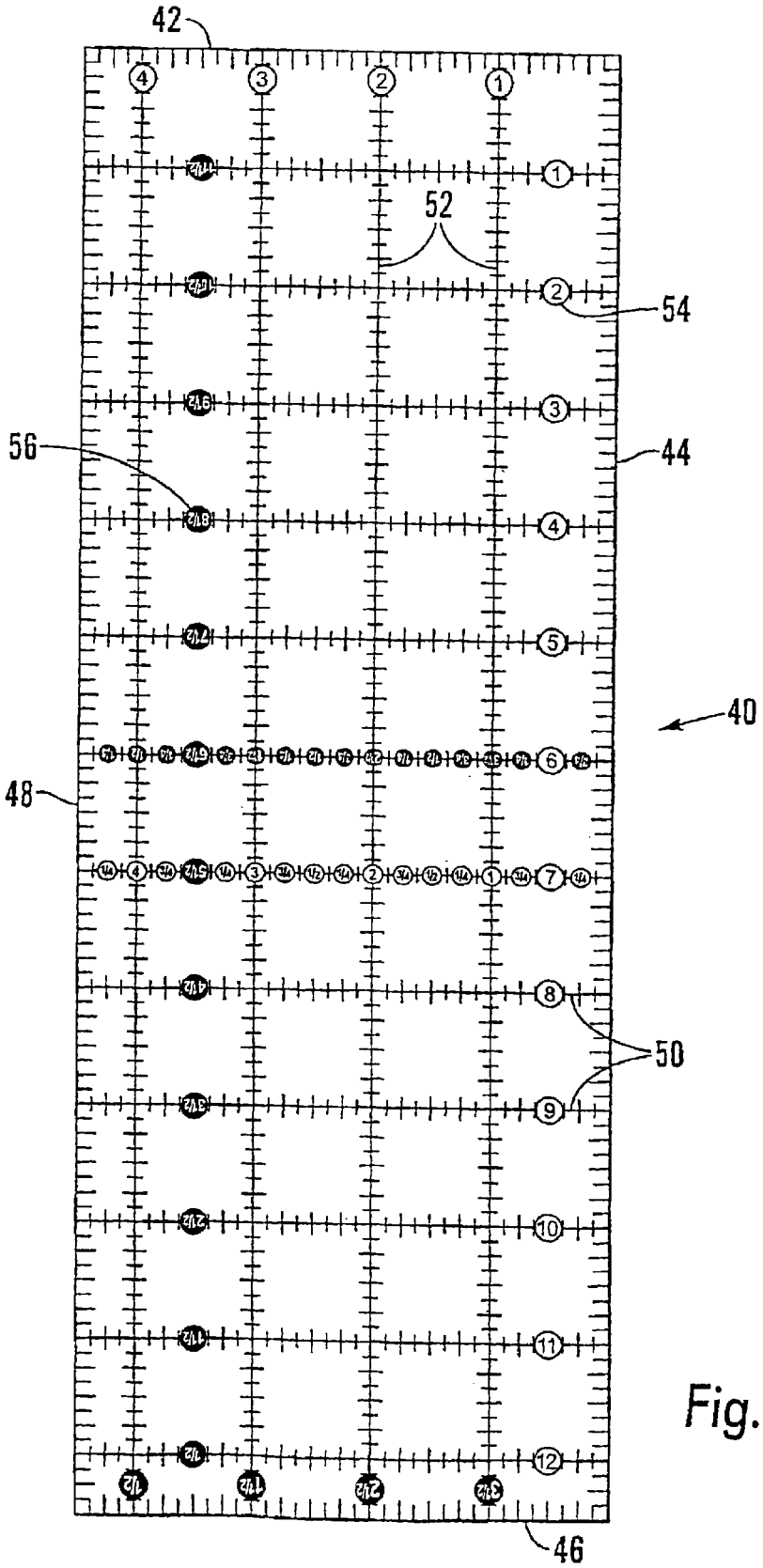

Three embodiments of quilting rulers will now be described with reference to the accompanying drawings in which FIG. 1 shows an embodiment of a square quilting ruler, FIG. 2 shows the ruler of FIG. 1 rotated through 180 degrees, FIG. 3 shows a first embodiment of a rectangular quilting ruler and FIG. 4 shows an alternative embodiment of a rectangular quilting ruler.

As can be seen from FIGS. 1 and 2, a square quilting ruler shown generally at 10 comprises a square of clear acrylic material with edges 2,4,6 and 8. A first set of rulings 12 and a second set of rulings 14 are printed on the ruler, parallel to the edges 2 and 6 of the ruler and 4 and 8 respectively. The first set of rulings 12 are spaced at one inch intervals from edge 2 and at one half inch, one and one half inches and so on from the edge 6 of the ruler. The second set of rulings 14 are spaced at one inch intervals from edge 4 and at one half inch, one and one half inches and so on from the edge 8 of the ruler.

Sets of reference numbers 16 and 18 indicate the distance of each line from the right hand or upper reference edge.

When the ruler is positioned as shown in FIG. 1 the user can read the first set of reference numbers 16 which are relevant to that orientation of the ruler, and as can be seen from FIG. 2 rotation of the ruler through 180 degrees allows the user to read the second set of reference numbers 18 which are relevant to that orientation of the ruler.

The ruler 10 is further provided with non-slip markings (not shown) on the reverse face thereof.

As can be seen from FIG. 3, a rectangular quilting ruler shown generally at 20 comprises a square of clear acrylic material with edges 22,24,26 and 28. A first set of rulings 30 and a second set of rulings 32 are printed on the ruler, parallel to the edges 22 and 26 and 24 and 28 respectively of the ruler. The first set of rulings 30 are spaced at one inch intervals from edge 22 and at one half inch, one and one half inches and so on from the edge 26 of the ruler. The second set of rulings 32 are spaced at one inch intervals from edge 24 and from the edge 28 of the ruler.

As can be seen from FIG. 4, an alternative embodiment of a rectangular quilting ruler shown generally at 40 comprises a square of clear acrylic material with edges 42,44,46 and 48. A first set of rulings 50 and a second set of rulings 52 are printed on the ruler, parallel to the edges 42 and 46 and 44 and 48 respectively of the ruler. The first set of rulings 50 are spaced at one inch intervals from edge 42 and at one half inch, one and one half inches and so on from the edge 46 of the ruler. The second set of rulings 52 are spaced at one inch intervals from edge 44 and at one half inch, one and one half inches and so on from the edge 48 of the ruler.

Sets of reference numbers 34 and 36 and 54 and 56 indicate the distance of each line from the right hand or upper reference edge. When the ruler is positioned as shown in FIG. 3 or 4 the user can read the first set of reference numbers 34 or 54 which are relevant to that orientation of the ruler, and as with the ruler of FIG. 1, rotation of the ruler through 180 degrees allows the user to read the second set of reference numbers 36 or 56 which are relevant to that orientation of the ruler.

The ruler 20 or 40 is further provided with non-slip markings (not shown) on the reverse face thereof.

What is claimed is:

1. A quilting ruler comprising: a single rectangular body having first, second, third and fourth peripheral edges, with a first set of equally spaced rulings running parallel to the first and third peripheral edges of the ruler and at right angles to a second set of equally spaced rulings running parallel to the second and fourth peripheral edges of the ruler, wherein the first line of the first set of rulings is spaced from the first peripheral edge of the ruler by a different interval from the interval by which the last line of that set of rulings is spaced from the third peripheral edge of the ruler and the distance between the equally spaced rulings of the first set of rulings is greater than the interval by which the last line of the first set of rulings is spaced from the third peripheral edge of the ruler, and the distance of each line of the first set of rulings from the first peripheral edge and of each line of the second set of rulings from the second peripheral edge is marked with reference numbers so as to be orientated for reading when the first and second peripheral edges of the ruler are in use and the distance of each line of the first set of rulings from the third peripheral edge and of each line of the second set of rulings from the fourth peripheral edge is marked with reference numbers so as to be orientated for reading when the third and fourth peripheral edges of the ruler are in use.

2. A quilting ruler according to claim 1 characterised in that the first line of the first set of rulings is spaced at an interval of one inch from the first edge of the ruler and successive lines in the first set of rulings are spaced each at one inch from the previous line and the last line in the first set of rulings is spaced at an interval of one half inch from the third edge of the ruler.

3. A quilting ruler according to claim 1 characterised in that the first line of the second set of rulings is spaced from the second edge of the ruler by a different interval from the interval by which the last line of that set of rulings is spaced from the fourth edge of the ruler and the distance between the equally spaced rulings of the second set of rulings is greater than the interval by which the last line of the second set of rulings is spaced from the fourth peripheral edge of the ruler.

4. A quilting ruler according to claim 1 characterised in that the first line of the second set of rulings is spaced at an interval of one inch from the second edge of the ruler and successive lines in the second set of rulings are spaced each at one inch from the previous line and the last ruling in the second set of rulings is spaced at an interval of one half inch from the fourth edge of the ruler.

5. A quilting ruler according to claim 1 characterised in that the distance of each line of the first set of rulings from the first edge and of each line of the second set of rulings from the second edge is marked by printing a reference numeral on the surface of the ruler, specifying the distance of that line from the edge of the ruler so as to be orientated for reading when the first and second edges of the ruler are in use and the distance of each ruling of the first set of rulings from the third edge and of each ruling of the second set of rulings from the fourth edge is marked so as to be orientated for reading when the third and fourth edges of the ruler are in use.

6. A quilting ruler according to claim 5 characterised in that the set of reference numbers specifying the distances from the first and second edges are printed inverted by 180 degrees relative to the set of reference numbers specifying the distances from the third and fourth edges.

7. A quilting ruler according to claim 6 characterised in. that the reference numbers are printed in manner in a combination of colours in order to enhance visibility on differently colored fabrics.

8. A quilting ruler according to claim 1 characterised in that the ruler is made from a transparent material.

9. A quilting ruler according to claim 8 characterised in that the ruler is made from cast or extruded acrylic.

10. A quilting ruler according to claim 1 characterised in that the ruler is provided with a non-slip surface on its reverse or fabric contacting face.

11. A quilting ruler having a square or rectangular shape comprising:

first, second, third, and fourth peripheral edges; and a first set of equally spaced rulings running parallel to the first and third edges and at right angles to a second set of equally spaced rulings running parallel to the second and fourth edges of the ruler, wherein the first line of the first set of rulings is spaced from the first edge of the ruler by a different interval than from a second interval by which the last line of the first set of rulings is spaced from the third edge of the ruler and the distance of each line of the first set of rulings from the first edge and of each line of the second set of rulings from the second edge is marked with reference numerals and orientated for reading when the first and second edges of the ruler are positioned to meet in the upper right hand corner of the ruler, and the distance of each line of the first set of rulings from the third edge and of each line of the second set of rulings from the fourth edge is marked with reference numerals and orientated for reading when the third edge and fourth edge are positioned to meet in the upper right hand corner.

12. The quilting ruler according to claim 11, wherein the first line of the first set of rulings is spaced at an interval of one inch from the first edge of the ruler and successive lines in the first set of rulings are each spaced one inch from the previous line and the last line in the first set of rulings is spaced at an interval of one half inch from the third edge of the ruler.

13. The quilting ruler of claim 11, wherein the first line and the last line of the first set of rulings extend substantially from the second edge to the fourth edge.

14. The quilting ruler of claim 11, wherein the first line and the last line of the second set of rulings extend substantially from the first edge to the third edge.

15. A quilting ruler comprising:

a single rectangular body having first, second, third and fourth peripheral edges; wherein the first and third peripheral edges are parallel to each other and at right angles to the second and fourth peripheral edges; and a first set of equally spaced rulings running parallel to the first and third edges and at right angles to the second and fourth edges of the ruler, wherein the first set of rulings are equally spaced commencing from the first peripheral edge along the entire length of the second edge and defines a first predetermined equal spacing interval from the first edge and the first set of rulings defines a second predetermined spacing interval from the third edge, and wherein the first set of rulings has a first line closest to the first edge and a last line closest to the third edge wherein the spacing from the first edge to the first line is greater than the spacing from the third edge to the last line.

16. The quilting ruler of claim 15, further comprising:

a second set of equally spaced rulings running parallel to the second and fourth edges and at right angles to the first and third edges of the ruler, wherein the second set of rulings are equally spaced commencing from the second peripheral. edge along the entire length of the first peripheral edge and defines a third predetermined equal spacing interval from the second edge and the second set of rulings define a fourth predetermined spacing interval from the fourth edge, and wherein the second set of rulings has a first line closest to the second edge and a last line closest to the fourth edge wherein the spacing from the second edge to the first line of the second set of rulings is greater than the spacing from the fourth edge to the last line of the second set of rulings.

17. The quilting ruler of claim 16 wherein each line of the second set of rulings defining the third predetermined equal spacing interval has reference numeral markings denoting the spacing from the second edge, said reference numeral markings orientated for reading when the ruler is in a first position, and the second set of rulings defining the fourth predetermined interval has additional reference numeral markings denoting the spacing from the fourth edge, said additional reference numeral markings orientated for reading when the ruler is in a second position, wherein the first position is orientated 180° from the second position.

18. The quilting ruler of claim 16 wherein each line of the first set of rulings defining the first predetermined equal spacing interval has a first set of reference numeral markings denoting the spacing from the first edge, said first set of reference numeral markings orientated for reading when the ruler is in a first position and the first set of rulings defining the second predetermined spacing interval has a second set of reference numeral markings denoting the spacing from the third edge, and second set of reference numeral markings orientated for reading when the ruler is in a second position, wherein the second set of reference numeral markings position is orientated 180° from the first set of reference numeral markings, and each line of the second set of rulings defining the third predetermined equal spacing interval has a third set of reference numeral markings denoting the spacing from the second edge, said third set of reference numeral markings and orientated for reading when the ruler is in the first position and the second set of rulings defining the fourth predetermined spacing interval has a fourth set of reference numeral markings denoting the spacing from the fourth edge, said fourth set of reference numeral markings orientated for reading when the ruler is in the second position, wherein the fourth set of reference numeral markings is orientated 180° from the third set of reference numeral numbers.

19. The quilting ruler of claim 15 wherein each line of the first set of rulings defining the first predetermined equal spacing interval has reference numeral markings denoting the spacing from the first edge said reference numeral markings orientated for reading when the ruler is in a first position, and the first set of rulings defining the second predetermined interval has additional reference numeral markings denoting the spacing from the third edge, said additional reference numeral markings orientated for reading when the ruler is in a second position, wherein the second position is orientated 180° from the first position.

* * * * *